United States Patent [19]

Kii

[11] 4,259,556

[45] Mar. 31, 1981

[54] GAS PUFFER-TYPE CIRCUIT INTERRUPTER

[75] Inventor: Masami Kii, Amagasaki, Japan

[73] Assignee: Mitsubishi Denki Kabushiki Kaisha, Tokyo, Japan

[21] Appl. No.: 889,552

[22] Filed: Mar. 23, 1978

[30] Foreign Application Priority Data

Mar. 24, 1977 [JP] Japan ..... 52-32920
Mar. 24, 1977 [JP] Japan ..... 52-32923
Mar. 24, 1977 [JP] Japan ..... 52-32925

[51] Int. Cl.[3] ..... H01H 33/74

[52] U.S. Cl. ..... 200/148 R; 200/148 B; 200/148H

[58] Field of Search ..... 200/148 R, 148 A, 148 B, 200/148 C, 148 D, 148 E, 148 F, 148 G, 148 H, 148 J, 148 BV, 150 D, 150 G, 144 R

[56] References Cited

U.S. PATENT DOCUMENTS 4,046,979 9/1977 Hertz et al. ..... 200/148 A
4,139,752 2/1979 Itai et al. ..... 200/148 G X

FOREIGN PATENT DOCUMENTS 47-29345 12/1972 Japan ..... 200/148 B
49-42465 4/1974 Japan ..... 200/148 B

*Primary Examiner*—Gene Z. Rubinson
*Assistant Examiner*—Morris Ginsburg
*Attorney, Agent, or Firm*—Robert E. Burns; Emmanuel J. Lobato; Bruce L. Adams

[57] ABSTRACT

A circuit interrupter comprises a pressure chamber and an arc extinguishing chamber containing an arc extinguishing fluid and a pair of separable contacts. The pressure chamber includes a separation chamber including a guide member or a check valve for supplying a high pressure fluid derived from an electric arc generated between the contacts to the pressure chamber. The high pressure fluid supplied from the high pressure chamber extinguishes the arc between the contacts. The guide member or the separation chambers alleviate mixing of the hot high pressure fluid with the cold high pressure fluid in the pressure chamber, providing the circuit interrupter with an improved arc extinguishing capability.

6 Claims, 4 Drawing Figures

GAS PUFFER-TYPE CIRCUIT INTERRUPTER

BACKGROUND OF THE INVENTION

1. Field of the Invention

This invention relates to circuit interrupters which extinguish an electric arc by puffing an arc extinguishing fluid such as $SF_6$ gas, and more particularly to circuit interrupters arranged to increase the pressure of the arc extinguishing fluid by the energy of the electric arc itself.

2. Description of the Prior Art

The self-extinguishing gas circuit interrupter which has been recently proposed comprises a pair of separable contacts disposed within an arc extinguishing chamber and a pressure chamber containing an arc extinguishing fluid such as $SF_6$ gas, which pressure chamber is adapted to be highly pressurized by utilizing the energy of the electric arc established between the contacts and dissipated and transmitted to the surrounding extinguishing gas. The high pressure gas contained in the pressure chamber is released upon alleviation or reduction of the choking function based on a decrease in arc inner pressure or arc diameter, which rapidly decreases with a decrease in arc current, thereby extinguishing the arc by the arc extinguishing function of the continuing high pressure gas flow.

In this type of self-extinguishing gas circuit interrupter, it is critical to maintain the pressure of the arc extinguishing gas for a desired arc extinguishing function such as the arc diffusing or cooling function.

However, since the pressure increase of the arc extinguishing gas is obtained by heating the arc extinguishing gas so that it dissociates or expands by utilizing the high temperture of the generated arc, the arc extinguishing gas has a strong tendency to reach a high temperature as it becomes a high pressure gas, rendering the arc extinguishing gas to be less effective in extinguishing the arc.

More specifically, since the generated arc is unstable in its track and moves around within the arcing region and changes its form while it is arcing, the arc extinguishing gas within the arcing region is stirred by the hot high pressure gas generated by the moving arc and the stirred arc extinguishing gas flows into the pressure chamber in which the high pressure gas for arc extinction is stored, thereby disturbing or stirring the arc extinguishing gas within the pressure chamber. This stirring or disturbance of the gas promotes temperature diffusion, resulting in an increase of the temperature of the entire arc extinguishing gas within the arc extinguishing chamber, thereby degrading the arc extinguishing capabilities including the cooling, diffusing and insulating capabilities. Also, the turbulent flow within the pressure chamber remains until the high pressure is released thereby, disturbing the flow of the released gas to cause pressure loss, and also resulting in a decrease in arc extinguishing capability.

SUMMARY OF THE INVENTION

Accordingly, an object of the present invention is to provide a circuit interrupter improved in respect to the above mentioned disadvantages of the prior art gas circuit interrupters and having an improved arc extinguishing ability with a simple and inexpensive structure.

With this object in view, the present invention resides in a circuit interrupter comprising an arc extinguishing chamber containing an arc extinguishing fluid such as $SF_6$ gas and a pair of separable contacts at least one of which is movable. The arc extinguishing chamber includes therein a pressure chamber which has a plurality of smaller chambers. The pressure chamber also includes a guide member or a separation chamber or a check valve for supplying a high pressure arc extinguishing fluid generated by an electric arc established between the separated contacts to the pressure chamber, thereby extinguishing the arc with the high pressure arc extinguishing fluid stored in the small chambers.

The guide memer or the separation chamber regulates the flow of the hot high-pressure gas into the pressure chamber to prevent disturbance or stirring of the gas within the pressure chamber, thereby preventing temperature diffusion within the pressure chamber due to turbulent flow or disturbance therein. In other words, mixing of the hot high pressure fluid with the cold fluid is alleviated within the pressure chamber to prevent a temperature increase of the entire arc extinguishing fluid within the pressure chamber.

On the other hand, since the propagation speed of the pressure of the arc extinguishing fluid and the temperature diffusion and transmission speed are different, i.e., the pressure propagation speed is greater than the temperature diffusion and transmission speed, the arc extinguishing fluid within the pressure chamber is rapidly increased in pressure before the hot high pressure fluid flows into the small chambers through the separation chamber or the guide member. Therefore the fluid within the pressure chamber becomes pressurized without becoming hot. The guide member or the separation chamber may be formed of a metallic cylindrical member. The small chambers may be radially disposed around the cylindrical guide member for guiding the hot high pressure fluid.

The invention will now be described in more detail in relation to the preferred embodiments of the invention taken in conjunction with the accompanying drawings, in which:

DESCRIPTION OF THE PREFERRED EMBODIMENTS

Figure 2:
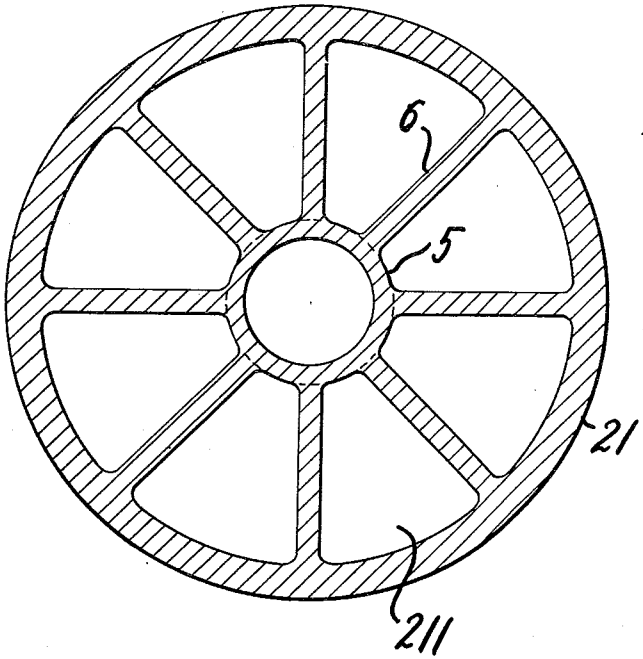
FIG. 2 is a cross sectional view taken along the line II—II of FIG. 1.
Figure 1:
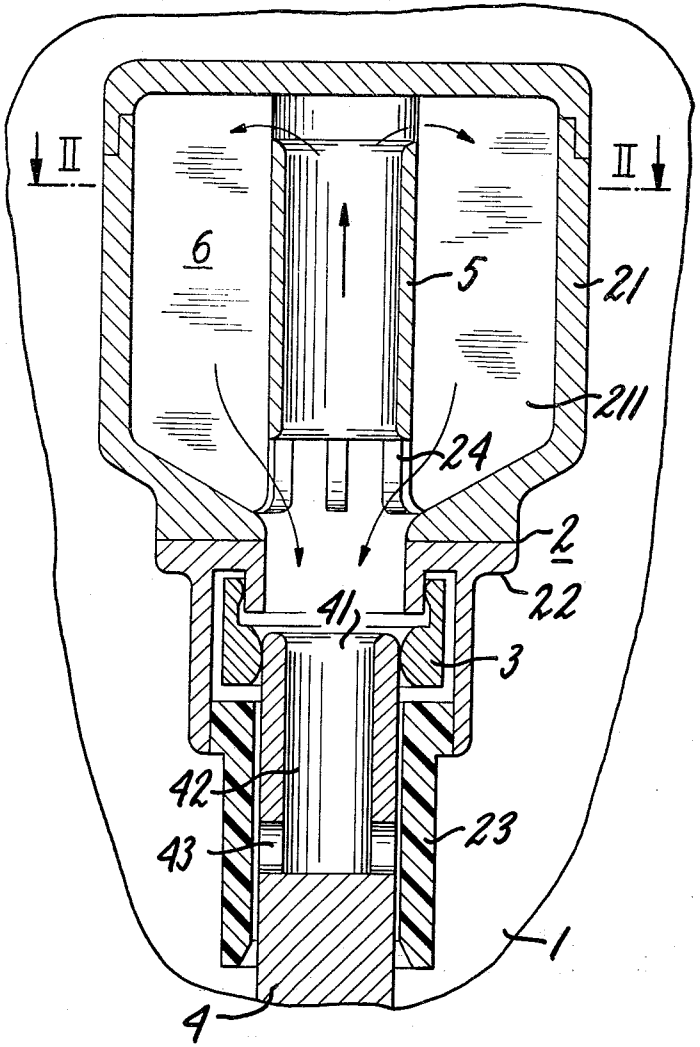
FIG. 1 is a sectional view illustrating one embodiment of the circuit interrupter of the present invention.

Referring now to FIG. 1 and FIG. 2 of the drawings, the circuit interrupter of the present invention comprises a casing 1 containing an arc extinguishing gas such as $SF_6$ gas. The casing 1 also contains therein an arc extinguishing chamber 2 containing therein an arc extinguishing gas such as $SF_6$ gas. The arc extinguishing chamber is adjacent a pressure chamber 21 formed of a metallic material. An arc extinguishing chamber main body 22 formed of an electrically conductive material, and a flow guide 23 formed of an insulating material having arc proof characteristics comprise the arc extinguishing chamber 2. The circuit interrupter further comprises a stationary contact 3 disposed in the arc extinguishing chamber main body 22, a movable contact 4 having a nozzle 41, gas passage 42 and opening 43 and supported by any conventional operating mechanism (not illustrated) so as to be separable from the stationary contact 3. Disposed within the pressure chamber 21 is a cylindrical member 5 for directing a high temperature, high pressure gas heated and pressurized by an electric arc generated across the separable contacts 3 and 4 toward the upper portion of the pressure chamber 21. The cylindrical member 5 is supported from the wall of the pressure chamber 21 by a plurality of radially extending partition walls 6 to form an opening 24 between its lower edge and the bottom opening of the pressure chamber 21. The partition walls 6 define a plurality of small chambers 211 between the pressure chamber 21 and the cylindrical member 5.

When the unillustrated operating mechanism is operated by a trip command, the movable contact 4 moves downward in FIG. 1, and after a predetermined wiping distance is reached both contacts 3 and 4 separate from each other to generate an electrical arc thereacross. The generated arc heats and expands the arc extinguishing gas within the arcing region to dissociate the gas into high temperature, high pressure gas. At this time, since the opening 43 is still closed, the generated high temperature, high pressure gas flows upward within the cylindrical member 5 into the upper portion of the small chambers 211 of the pressure chamber 21 as indicated by arrows in the Figure as a turbulent flow because of the instability and the movement of the arc due to it being a self-driven electric arc. The gas flow is separated in the small chambers 211 and smoothed to eliminate turbulence and cooled by the partition walls 6, and stored within the small chambers 211.

Since the gas pressure propagation speed of the arc extinguishing gas directed by the cylindrical member 5 is great enough, the high pressure is quickly propagated over the upper portion of the pressure chamber 21 and the small chambers 211, and the arc extinguishing gas within the entire pressure chamber 21 is increased in pressure within a very short time. On the other hand, although the gas temperature is also propagated along the same path as in the case of pressure propagation, since the temperature propagation speed is very slow compared to the pressure propagation speed, the temperature within the pressure chamber or the small chambers is elevated only to a small extent while most of the high temperature stays in the cylindrical member 5.

As the movable contact 4 moves further downward, the gas pressure within the small chambers 211 of the pressure chamber 21 becomes high enough to blow off the arc and the opening 43 opens to the interior of the casing 1, causing the gas to flow through the opening 24 in the downward direction into the arcing region where it is diffused. The flow and diffusion of the gas into the arcing region is effective because there is substantially no pressure loss due to the fact that there is no vortex or the like within the small chambers 211. The gas puffed into the arcing region is low in temperature and high in pressure, resulting in an efficient cooling and diffusion of the arc causing it to quickly extinguish. It is to be noted that the present invention is also applicable to the circuit interrupter arranged to allow the electric arc to penetrate through the pressure chamber 21.

Figure 3:
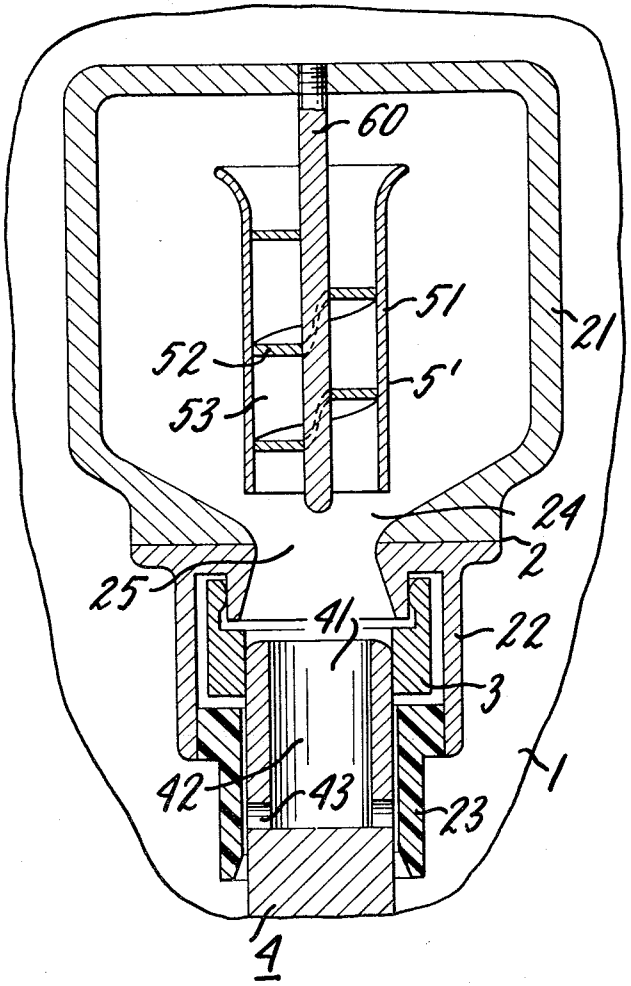
FIG. 3 is a sectional view illustrating another embodiment of the circuit interrupter of the present invention.

FIG. 3 illustrates another embodiment of the present invention, wherein a casing 1 contains an arc extinguishing gas such as $SF_6$ gas. Within the casing 1 is disposed an arc extinguishing chamber 2 containing therein an arc extinguishing gas such as $SF_6$ gas. The arc extinguishing chamber 2 comprises, a main body 22 formed of an electrically conductive material, and a flow guide 23 formed of an electrically insulative material having arc-withstanding properties. The circuit interrupter further comprises a stationary contact 3 disposed within the arc extinguishing chamber main body 22, and a movable contact 4 having a nozzle 41, gas passage 42 and opening 43. The movable contact 4 is supported by any conventional operating mechanism (not shown) so as to be separable from the stationary contact 3 when the operating mechanism is operated. Disposed within the pressure chamber 21 to define an opening 24 between the lower portion of the pressure chamber 21 and its lower edge is a guide member 5' for guiding the high temperature, high pressure gas generated by the electric arc established between the separable contacts 3 and 4 to the upper region of the guide member 5'. The guide member 5' is composed of a hollow cylindrical member 51, a spiral guide plate 52 secured within the cylindrical member 51 to form a spiral gas passage 53 therein and a support rod 60 for supporting the guide member 5' from the top wall of the pressure chamber 21. The pressure chamber 21, the gas passage 25 formed in the arc extinguishing chamber main body 22, and the opening 24 are arranged to have relative position, configuration and size so that most of the high pressure gas due to the electric arc established between the separable contacts 3 and 4 is introduced into the guide member 5' and that the high pressure gas stored within the pressure chamber 21 blasts out through the opening 24 upon the arc extinction operation.

When the unillustrated conventional operating mechanism is driven at the trip command, the movable contact 4 is caused to move downward. After a predetermined wiping distance is covered both the contacts 3 and 4 separate from each other to establish an electric arc therebetween. The established arc causes the arc extinguishing gas within the arcing region to develop a high pressure and high temperature, which gas is then introduced into the pressure chamber 21 through the gas passages 25 and 53. Since the pressure propagation speed of the gas guided by the guide member 5' is very high, the pressure is rapidly propagated through the spiral gas passage 53 into the upper portion of the pressure chamber 21 within a short time. On the other hand, although the gas temperature is also propagated along the same route as the pressure, since its propagation speed is very slow, temperature rise takes place only to a limited extent within the pressure chamber and stays within the guide member 5'.

As the movable contact 4 moves further downward, the opening 43 opens to the interior of the casing 1 and the arc current approaches zero. As the choking function of the electric arc extinguishes, the arcing region is opened to rapidly decrease the pressure and the temperature within the arcing region. At the same time, the high pressure gas which is kept at a low temperature within the pressure chamber 21 is released through the opening 24 into the arcing region where it is diffused, and then released to the interior space of the casing 1. Since the high temperature gas stays within the guide member 5' during the above operation because of the restricted flow rate due to the flow resistance of the long spiral gas passage 53, almost all the gas blasted into the arcing region through the opening 24 is the low temperature, high pressure gas having a good diffusion and cooling function stored within the pressure chamber 21. Therefore, quick extinction of the established arc is achieved simultaneously with a zero arc current.

When the cylindrical member 51 and the spiral guide plate 52 of the guide member 5' are formed of a metallic material, and arranged to contact the high temperature gas flowed from the arcing region, the arc extinction ability of the gas is increased due to the cooling function of the metallic members. With this arrangement, even if the residing gas within the guide member 5' directly flows into the arcing region upon opening thereof, the arc extinction ability of the gas is not affected because the residing gas is cooled to a low enough temperature. Also, the inner and the outer surfaces of the guide member 5' may have rough faces to increase the surface area to further improve the contact heat transfer and heat absorbing effect of the metallic members. Substantially the same effect may be obtained with a gas passage 53 divided into small straight sections.

Figure 4:
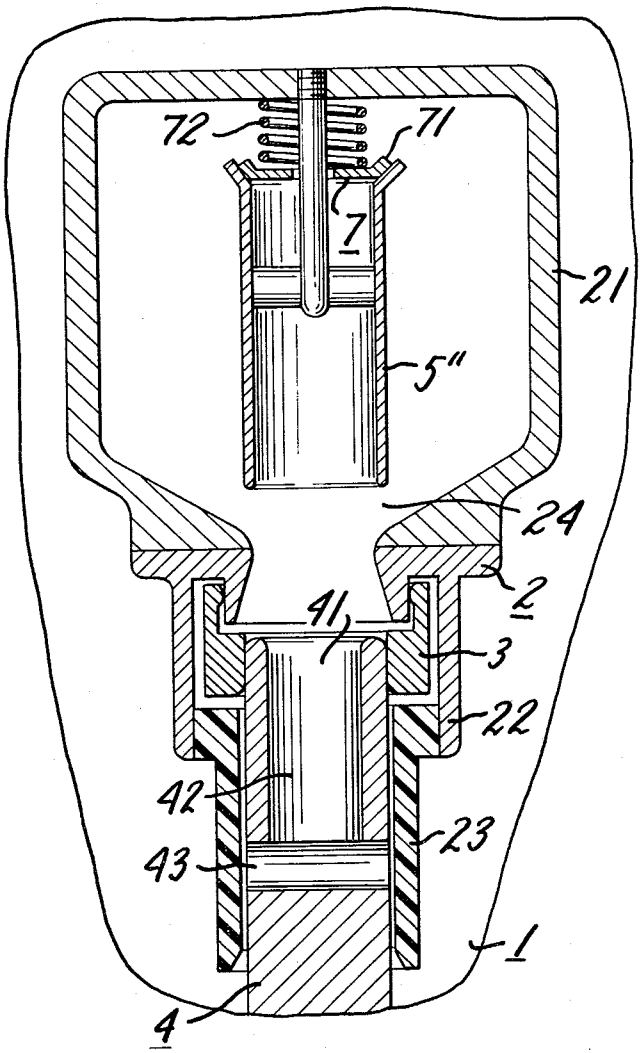
FIG. 4 is a sectional view illustrating still another embodiment of the circuit interrupter of the present invention.

FIG. 4 illustrates still another embodiment of the circuit interrupter constructed in accordance with the present invention. The illustrated circuit interrupter comprises a casing 1 containing an arc extinguishing gas such as $SF_6$ gas, an arc extinguishing chamber 2 containing therein an arc extinguishing gas such as $SF_6$ gas, a pressure chamber 21 formed of a metallic material, an arc extinguishing chamber main body 22 formed of an electrically conductive material and a flow guide 23 formed of an electrically insulative material having an arc resistant property. The circuit interrupter also comprises a stationary contact 3 disposed within the main body 22 and a movable contact 4 separable from the stationary contact 3 by any conventional operating mechanism (not shown) and including a nozzle portion 41, a gas passage 42 and opening 43. Disposed within the pressure chamber 21 to define an opening 24 between the lower portion of the pressure chamber 21 is a separation chamber 5'' including a hollow cylindrical member for directing the high temperature, high pressure gas generated by the electric arc established between the separable contacts 3 and 4 into the upper portion of the pressure chamber 21. A check valve 7 including a valve 71 and a restore spring 72 is disposed at the upper portion of the cylindrical member 5'' for allowing the gas within the cylindrical member 5'' higher in pressure by a predetermined amount than that within the pressure chamber 21 to flow into the pressure chamber 21. The check valve 7 opens only when the pressure within the cylindrical member 5'' becomes higher than that in the pressure chamber 21 by a predetermined amount, thereby ensuring that the pressure within the pressure chamber 21 rapidly increases while limiting the temperature increases to a local region.

When the unillustrated conventional operating mechanism is driven by the trip command, the movable contact 4 moves downward. After the predetermined wiping distance is covered the separable contacts 3 and 4 separate from each other to establish an electric arc therebetween. The established arc heats the arc extinguishing gas within the arcing region to expand it into a high temperature, high pressure gas. Since the opening 43 is still closed at this stage, the high pressure, high temperature gas generated is directed into the separation chamber 5'' to open the check valve 7 and flows into the upper portion of the pressure chamber 21. Although the gas introduced into the pressure chamber 21 is high in temperature, the gas in the lower portion of the pressure chamber 21 is not elevated in temperature because of the slow propagation speed of the temperature. However, because of the high propagation speed of the pressure of the gas, the pressure of the gas within the pressure chamber is immediately increased. As the movable contact 4 further moves downward to open the opening 43 and the choking at the nozzle portion 41 by the arc is alleviated as the arc current approaches a zero value, the low temperature, high pressure gas stored within the pressure chamber 21 is released through the opening 24 into the arcing region to diffuse therein, thereby extinguishing the electric arc with its arc extinction ability.

On the other hand, the high temperature gas remaining in the upper portion of the pressure chamber 21 is released and diffused into the interior of the casing 1 following the low temperature, high pressure gas after the extinction of the electric arc.

As is apparent from the foregoing description, almost no high temperature, high pressure gas flows into the arcing region at the initial stage of opening the pressure chamber; only the low temperature, high pressure gas is allowed to flow thereinto, so that the arc extinguishing ability is quite excellent, fully utilizing the excellent performance of the self extinguishing puffer-type circuit interrupter.

As described above, the circuit interrupter of the present invention comprises a pressure chamber and an arc extinguishing chamber containing an arc extinguishing fluid, a pair of separable contacts, within said arc extinguishing chamber, a guide member or a separation chamber formed in the pressure chamber for supplying a high pressure fluid obtained by an electric arc established between the contacts into the pressure chamber, and small chambers defined by the guide member or the separation chamber for storing the low temperature, high pressure fluid, whereby the electric arc is extinguished by the low temperature, high pressure fluid stored within the small chambers. Since the high temperature, high pressure fluid is not mixed with the low temperature, high pressure fluid owing to the guide member or the separation chamber, the arc extinguishing capability is greatly improved with a simple inexpensive structure.

What is claimed is:

1. A circuit interrupter, comprising:

a casing for containing an arc extinguishing fluid;

means for defining an arc extinguishing chamber disposed within said casing and containing in use an arc extinguishing fluid, wherein said arc extinguishing chamber has an opening therethrough to permit arc extinguishing gas to be introduced into said arc extinguishing chamber;

a pair of separable contact elements disposed within said arc extinguishing chamber, wherein at least one of said contact elements is movable between a contacting position where said contact elements are in physical contact and separated positions where said contact elements are separated, and said movable contact element being positioned for blocking said opening through said arc extinguishing chamber when said movable contact element is in the contacting position.

a pressure chamber opening into said arc extinguishing chamber through said opening through said arc extinguishing chamber for permitting arc extinguishing fluid to be introduced from said pressure chamber into said arc extinguishing chamber when said movable contact element is separated a sufficient distance from the second of said contact elements and a pressure of arc extinguishing gas within said pressure chamber is sufficiently high;

a tubular cylinder within said pressure chamber having a first open end positioned for receiving high pressure high temperature gases generated in use within said said arc extinguishing chamber and which flow into said pressure chamber when said pair of contact elements are separated and an electric arc is established therebetween, and said tubular cylinder positioned with its second open end remote from said opening through said arc extinguishing chamber for establishing a gas flow path out of said arc extinguishing chamber through said opening, into the first open end of said tubular cylinder, through said tubular cylinder and out of the second open end thereof, and back through said pressure chamber to said opening through said arc extinguishing chamber, said tubular cylinder being effective for guiding the high temperature high pressure arc extinguishing fluid from said arc extinguishing chamber for pressurizing low temperature arc extinguishing fluid within said pressure chamber without substantially heating the low temperature arc extinguishing fluid within said pressure chamber so as to puff low temperature arc extinguishing fluid under pressure from said pressure chamber into said arc extinguishing chamber when an arc current is sufficiently low so as to extinguish the arc formed between said contact elements when the same are separated; and a plurality of partitions extending between said tubular cylinder and the interior wall of said pressure chamber for partitioning the interior of said pressure chamber into a plurality of compartments open adjacent both ends of said tubular cylinder for each defining a flow path for gas flowing out of said second open end of said tubular cylinder and back to said opening through said arc extinguishing chamber with low turbulence.

2. A circuit interrupter as claimed in claim 1, further comprising means within said tubular cylinder for imparting resistance to fluid flow through said tubular cylinder.

3. A circuit interrupter as claimed in claim 2, wherein said means for imparting resistance to fluid flow is comprised of a spiral guide plate disposed axially within said tubular cylinder for defining a spiral fluid flow path through said tubular cylinder.

4. A circuit interrupter as claimed in claim 1, further comprising a check valve disposed closing said second open end of said tubular cylinder for controlling the flow of the high temperature high pressure arc extinguishing fluid therethrough when a fluid pressure difference across said check valve exeeds a predetermined value and for closing said second open end of said tubular cylinder when the fluid pressure difference is less than the predetermined value.

5. A circuit interrupter as claimed in claim 2, 3, 4 or 5, wherein said partitions are disposed circumferentially around said tubular cylinder and radially therefrom for defining parallel fluidflow paths for the low temperature arc extinguishing fluid which flows under pressure from said pressure chamber.

6. A circuit interrupter as claimed in claim 2, 3, 4 or 1, wherein said partitions are effective for cooling high temperature gas which flows into said pressure chamber.

* * * * *